US009050836B2

(12) United States Patent
Oe

(10) Patent No.: US 9,050,836 B2
(45) Date of Patent: Jun. 9, 2015

(54) PRINTER WITH TRANSFER BELT AND SHEET PRESSING ROLLER

(71) Applicant: RISO KAGAKU CORPORATION, Tokyo (JP)

(72) Inventor: Tomohisa Oe, Tsukuba (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/313,520

(22) Filed: Jun. 24, 2014

(65) Prior Publication Data

US 2014/0375739 A1 Dec. 25, 2014

(30) Foreign Application Priority Data

Jun. 25, 2013 (JP) ..... 2013-132349

(51) Int. Cl.
*B41J 25/308* (2006.01)
*B41J 11/00* (2006.01)

(52) U.S. Cl.
CPC ..... *B41J 11/0085* (2013.01); *B41J 11/005* (2013.01); *B41J 11/007* (2013.01)

(58) Field of Classification Search
CPC ..... B41J 25/3084; B41J 25/3088; B41J 25/3082; B41J 25/308; B41J 11/42; B41J 11/007
USPC ..... 347/8, 16, 104
See application file for complete search history.

(56) References Cited

U.S. PATENT DOCUMENTS

2004/0160475 A1* 8/2004 Satoh et al. ..... 347/36
2006/0098070 A1* 5/2006 Kumagai ..... 347/101

FOREIGN PATENT DOCUMENTS

JP 2006-137027 A 6/2006

* cited by examiner

*Primary Examiner* — Henok Legesse
(74) *Attorney, Agent, or Firm* — Greenblum & Bernstein P.L.C.

(57) ABSTRACT

A printer is provided with a transfer belt, a sucking fan, a printing portion, and an inter-head guide roller. The printing portion has a head row and a head holder. The inter-head guide roller is rotatably supported by a pair of support portions fixedly arranged on the head holder on one end side and the other end side of the inter-head guide roller. A plurality of belt holes is arranged on the transfer belt so that the plurality of belt holes passes just below each support portion when the transfer belt is moving.

7 Claims, 5 Drawing Sheets

PRINTER WITH TRANSFER BELT AND SHEET PRESSING ROLLER

CROSS REFERENCE TO RELATED APPLICATION

This application claims benefit of priority under 35 U.S.C. §119 to Japanese Patent Application No. 2013-132349, filed on Jun. 25, 2013, the entire contents of which are incorporated by reference herein.

BACKGROUND OF THE INVENTION

1. Field of the Invention

The present invention relates to a printer that performs printing on a sheet or the like.

2. Description of the Related Art

A printer that performs printing by discharging ink droplets onto a sheet from an ink head while attracting and holding the sheet on a transfer belt and transferring it, has been known.

In such a printer, if the sheet floats above the transfer belt, it might touch the ink head. If the sheet touches the ink head, the ink head might be damaged, or the sheet might be stained. Thus, a roller for preventing floating-up of the sheet by pressing the sheet onto the transfer belt is provided in some cases.

For example, in a recording device in Patent Literature 1 (Japanese Patent Application Laid-Open Publication No. 2006-137027), a guide roller is arranged on an upstream side of the sheet in a transfer direction for each of a plurality of recording heads arranged in a staggered state. This guide roller is rotatably supported by a paper-guide frame on which a paper-guide rib is provided. The sheet is guided to the guide roller while floating-up at a tip end portion thereof is suppressed by the paper-guide rib. Then, the sheet is transferred while being pressed onto a platen belt by the guide roller. As a result, contact of the sheet with the recording head is suppressed.

When an ink droplet is discharged from the ink head, an ink mist in which the ink has become a mist state occurs. The ink mist floats in the periphery of a discharge surface of the ink head. The floating ink mist might adhere to a peripheral member.

In the recording device of Patent Literature 1, the ink mist might adhere to a supporting portion of the paper-guide frame supporting the guide roller or the paper-guide rib. The ink mist does not easily adhere to the guide roller due to an influence of an air flow generated in the vicinity on the surface thereof during rotation of the guide roller.

If the ink mist adheres to the support portion or the paper-guide rib, when the sheet touches them, the ink might transfer to the sheet, and the sheet might be stained. Moreover, if the ink mist adhering to the support portion or the paper-guide rib accumulates, it becomes an ink droplet and drops onto the sheet, which might stain the sheet.

SUMMARY OF THE INVENTION

The present invention has been made in view of the above problem. An object of the present invention is to provide a printer which can reduce contact of a sheet with an ink head while a stain on the sheet is suppressed.

According to a first aspect of the present invention, there is provided a printer including: a transfer belt that has a plurality of belt holes, attracts and holds a sheet on a transfer surface, and moves so as to transfer the sheet; a sucking portion that sucks air through the plurality of belt holes to attract the sheet onto the transfer surface of the transfer belt; a printing portion that has a head row in which a plurality of ink heads each discharging an ink droplet from a discharge surface thereof faced with the transfer surface is aligned along a main scanning direction orthogonal to a transfer direction of the sheet, and a head holder for holding the plurality of the ink heads; and a sheet pressing roller that is arranged in parallel to the plurality of ink heads on a line formed by the head row and presses the sheet onto the transfer surface while rotating, wherein the sheet pressing roller is rotatably supported by a pair of support portions fixedly arranged on the head holder on one end side and the other end side of the sheet pressing roller; and the plurality of belt holes is arranged on the transfer belt so that the plurality of belt holes passes just below each support portion while the transfer belt is moving.

According to a second aspect of the present invention, a lower end of each support portion is located above the discharge surface of the ink head.

According to the first aspect of the present invention, the sheet can be pressed onto the transfer surface by the sheet pressing roller arranged in parallel to the ink heads on a line formed by the head row when the sheet passes below the discharge surface of the ink head. As a result, even if the sheet is curled, for example, contact of the sheet with the ink head can be reduced. Moreover, the belt holes of the transfer belt are arranged so that the plurality of belt holes passes just below each support portion when the transfer belt is moving. As a result, a height of a region in which the ink mist floats can be kept low just below each support portion. Thus, adhesion of the ink mist to each support portion can be suppressed. As a result, staining on the sheet by contact of the sheet with each support portion or the like can be suppressed. Moreover, since the sheet pressing roller is rotating during a printing operation, the ink mist cannot easily adhere to the sheet pressing roller. Thus, staining on the sheet by adhesion of the ink mist to the sheet pressing roller can be suppressed. Therefore, according to this aspect, contact of the sheet with the ink head can be reduced while stain on the sheet is suppressed.

According to the second aspect of the present invention, since the lower end of each support portion is located above the discharge surface of the ink head, adhesion of the ink mist to each support portion can be further suppressed. As a result, stain on the sheet can be further suppressed.

DESCRIPTION OF THE EMBODIMENTS

Figure 1:
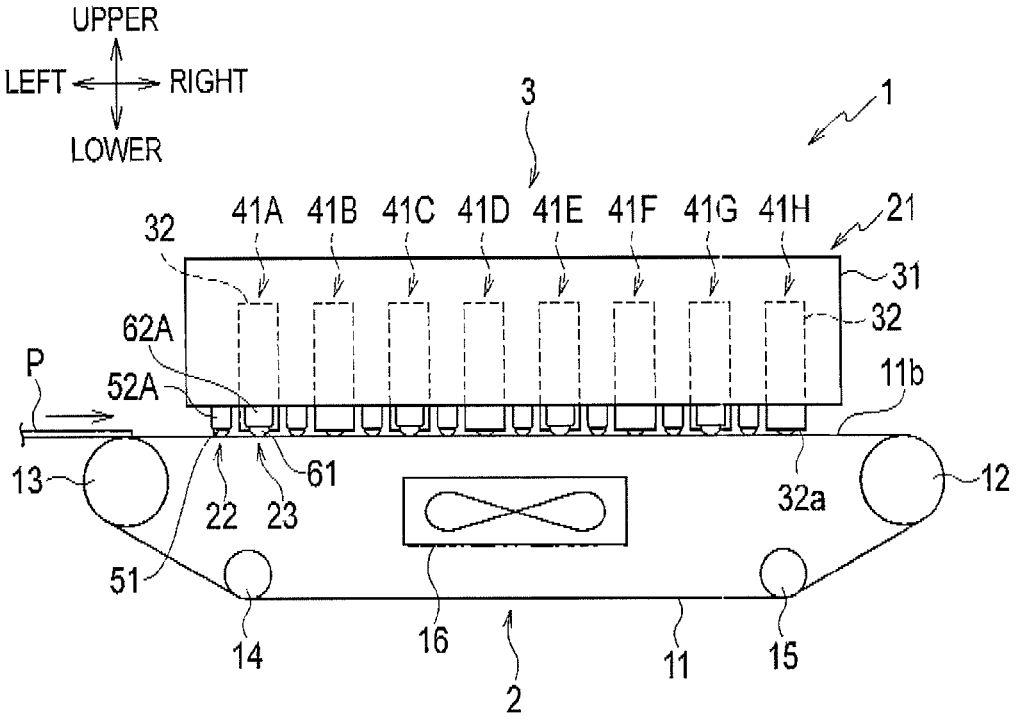
FIG. 1 is an outline configuration view of a printer according to an embodiment of the present invention.

An embodiment of the present invention will be described below by referring to the attached drawings. The same or equivalent portions and constituent elements throughout the drawings are given the same or equivalent reference numerals. However, the drawings are schematic, and attention should be paid that they are different from real ones. Moreover, it is needless to say that portions with a relationship or rates of dimensions different from each other are included in the drawings.

Moreover, the embodiment illustrated below exemplifies a device and the like for embodying a technical idea of this invention and the technical idea of this invention does not specify a material, a shape, a structure, arrangement and the like of each of the components to the following. The technical idea of this invention is capable of adding various changes within claims.

Figure 2:
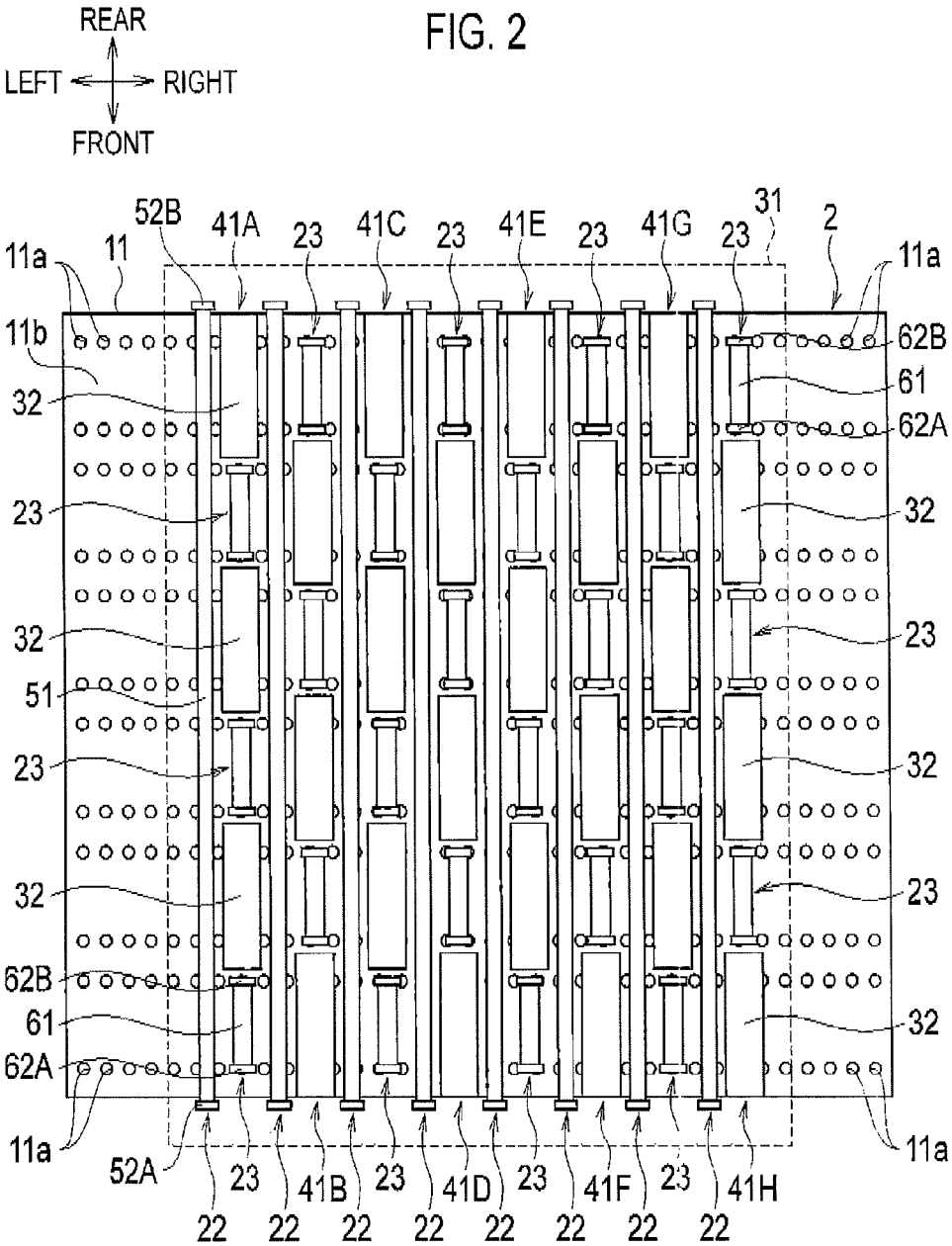
FIG. 2 is a plan view of the printer excluding a head holder according to the embodiment of the present invention.

FIG. 1 is an outline configuration view of a printer according to the embodiment of the present invention, and FIG. 2 is a plan view of the printer excluding a head holder. In the following description, a direction orthogonal to the paper surface in FIG. 1 is referred to as a longitudinal direction, and a front direction of the paper surface is referred to as a front. Moreover, as illustrated in FIG. 1, up, down, right, and left when seen from the front are referred to as upper, lower, right, and left directions. In FIG. 1, a direction from left to right is a sheet transfer direction. An upstream and a downstream in the following description refer to an upstream and a downstream in the sheet transfer direction.

As illustrated in FIG. 1, the printer 1 according to the present embodiment is provided with a transfer portion 2 and a head unit 3.

The transfer portion 2 transfers a sheet P. The transfer portion 2 is provided with a transfer belt 11, a driving roller 12, driven rollers 13, 14, and 15, and a sucking fan (sucking portion) 16.

The transfer belt 11 is an annular belt extended between the driving roller 12 and the driven rollers 13 to 15. In the transfer belt 11, a large number of belt holes 11*a* which are through holes for attracting/holding the sheet P are formed as illustrated in FIG. 2. The transfer belt 11 attracts/holds the sheet P on a transfer surface 11*b* by an attraction force generated in the belt holes 11*a* by driving of the sucking fan 16. The transfer surface 11*b* is an upper surface of the transfer belt 11 which is substantially horizontal between the driving roller 12 and the driven roller 13. The transfer belt 11 rotates/moves in a clockwise direction in FIG. 1 by driving of the driving roller 12. As a result, the transfer belt 11 transfers the sheet P attracted/held on the transfer surface 11*b* to a right direction. The belt holes 11*a* in the transfer belt 11 are arranged so that the plurality of belt holes 11*a* continuously passes just below support portions 62A and 62B of an inter-head sheet pressing portion 23 which will be described later when the transfer belt 11 moves. That is, as illustrated in FIG. 2, the plurality of belt holes 11*a* is aligned along the right-and-left direction over the entire periphery of the transfer belt 11 at positions where the support portions 62A and 62B are arranged in a longitudinal direction. The belt hole 11*a* may be provided at a position other than the positions illustrated in FIG. 2

The transfer belt 11 is extended between the driving roller 12 and the driven rollers 13 to 15. The driving roller 12 is rotated/driven by a motor, not shown, and rotates the transfer belt 11. The driven rollers 13 to 15 are driven by the driving roller 12 via the transfer belt 11. The driven roller 13 has substantially the same height as the driving roller 12 and is arranged on the left side of the driving roller 12. The driven rollers 14 and 15 are arranged at substantially the same height below the driving roller 12 and the driven roller 13, separated away from each other in a left-and-right direction.

The sucking fan 16 generates an air flow toward a lower direction. As a result, the sucking fan 16 sucks air through the belt holes 11*a* of the transfer belt 11, generates a negative pressure in the belt holes 11*a* to attract the sheet P onto the transfer surface 11*b*. The sucking fan 16 is arranged between the driving roller 12 and the driven roller 13.

The transfer portion 2 is configured capable of elevation by an elevation mechanism portion, not shown. As a result, a head gap Hg is made changeable. The head gap Hg is a distance between a discharge surface 32*a* of an ink head 32 which will be described later and the transfer surface 11*b* of the transfer belt 11.

The head unit 3 performs printing on the sheet P transferred by the transfer portion 2. The head unit 3 is arranged above the transfer portion 2. The head unit 3 is provided with a printing portion 21, a plurality of upstream-side sheet pressing portions 22, and a plurality of inter-head sheet pressing portions 23.

The printing portion 21 discharges ink droplets onto the sheet P to form an image. The printing portion 21 is provided with a head holder 31 and a plurality of ink heads 32.

The head holder 31 is a box body for holding the ink heads 32 above the transfer surface 11*b*. The head holder 31 is fixed in the housing (not shown) of the printer 1. On a bottom surface of the head holder 31, a plurality of opening portions (not shown) is formed at predetermined positions. Each ink head 32 is inserted into a corresponding opening portion and fixed.

The ink head 32 discharges ink droplets. In the printer 1, twenty-four ink heads 32 are held by the head holder 31. The ink heads 32 are inserted into the corresponding opening portions on the bottom surface of the head holder 31, and mounted so that lower end portions thereof protrude downward from a bottom surface of the head holder 31. Each ink head 32 has a plurality of nozzles opened in a discharge surface (lower surface) 32*a* and discharges the ink droplets from the nozzle. The ink heads 32 are arranged in a staggered state. More specifically, eight rows (head rows 41A, 41B, . . . , 41H) each composed of three ink heads 32 aligned at a predetermined pitch along a longitudinal direction (main scanning direction), are arranged at equal intervals in the left-and-right direction. The head rows 41A to 41H are arranged with positions in the longitudinal direction shifted every other rows only by a half pitch. The head rows 41A to 41H constitute a line head for one color by two adjacent rows. For example, the head rows 41A and 41B discharge the ink in black, the head rows 41C and 41D discharge the ink in cyan, the head rows 41E and 41F discharge the ink in magenta, and the head rows 41G and 41H discharge the ink in yellow. A length in the longitudinal direction of a region in which the ink heads 32 are arranged is substantially the same as a length of the transfer surface 11*b* in the longitudinal directions (width of the transfer belt 11). A length in the left-and-right direction of the region in which the ink heads are arranged is shorter than the length in the left-and-right direction of the transfer surface 11*b*.

The alphabetical suffixes in reference characters of the head rows 41A to 41H are omitted and noted collectively in some cases.

Each upstream-side sheet pressing portion 22 is to press the transferred sheet P onto the transfer surface 11*b* of the transfer belt 11 on an upstream side of each of the head rows 41. The eight upstream-side pressing portions 22 are arranged on the upstream sides of the head rows 41A to 41H, respectively. Each upstream-side sheet pressing portion 22 is provided with an upstream-side guide roller 51 and a pair of support portions 52A and 52B.

The upstream-side guide roller 51 presses the sheet P onto the transfer surface 11*b* while rotating. The upstream-side guide roller 51 is formed having a columnar shape elongated in the longitudinal direction. The upstream-side guide roller 51 extends over the entire width of the transfer belt 11 on the upstream side of each of the head rows 41. The upstream-side guide roller 51 is in contact with the transfer belt 11 and follows and rotates with the transfer belt 11. A surface of the upstream-side guide roller 51 is applied with ink repellant treatment such as fluorine resin coating.

The pair of support portions 52A and 52B rotatably support the upstream-side guide roller 51. The support portions 52A and 52B are fixed to a lower surface of the head holder 31. The support portions 52A and 52B are arranged on a front end side and a rear end side of the upstream-side guide roller 51, respectively, and rotatably support a front end portion and a rear end portion of a rotating shaft of the upstream-side guide roller 51, respectively. The support portions 52A and 52B are arranged outside of a region in which the ink heads 32 are arranged in the longitudinal direction. For the support portions 52A and 52B, a configuration similar to those of the support portions 62A and 62B of the inter-head sheet pressing portion 23 which will be described later can be employed, for example.

The inter-head sheet pressing portion 23 is to press the transferred sheet P onto the transfer surface 11*b* of the transfer belt 11 on a line formed by each of the head rows 41. The twenty-four inter-head sheet pressing portion 23 is arranged in a staggered state opposite to that of the ink heads 32. That is, each of the inter-head sheet pressing portions 23 is arranged in parallel to each of the ink heads 32 on the line formed by each of the head rows 41. The inter-head sheet pressing portion 23 is provided with an inter-head guide roller (sheet pressing roller) 61 and a pair of the support portions 62A and 62B.

The inter-head guide roller 61 presses the sheet P onto the transfer surface 11*b* while rotating. The inter-head guide roller 61 is formed having a columnar shape elongated in the longitudinal direction. The length of the inter-head guide roller 61 is slightly shorter than a gap between the ink heads in each of the head rows 41. The inter-head guide roller 61 is in contact with the transfer belt 11 and follows and rotates with the transfer belt 11. The surface of the inter-head guide roller 61 is applied with ink repellant treatment such as fluorine resin coating.

The pair of support portions 62A and 62B rotatably supports the inter-head guide roller 61 above the transfer surface 11*b*. The support portions 62A and 62B are fixed to the lower surface of the head holder 31. The support portions 62A and 62B are arranged on a front end side and a rear end side of the inter-head guide roller 61, respectively, and rotatably support a front end portion and a rear end portion of a rotating shaft of the inter-head guide roller 61, respectively.

Figure 3:
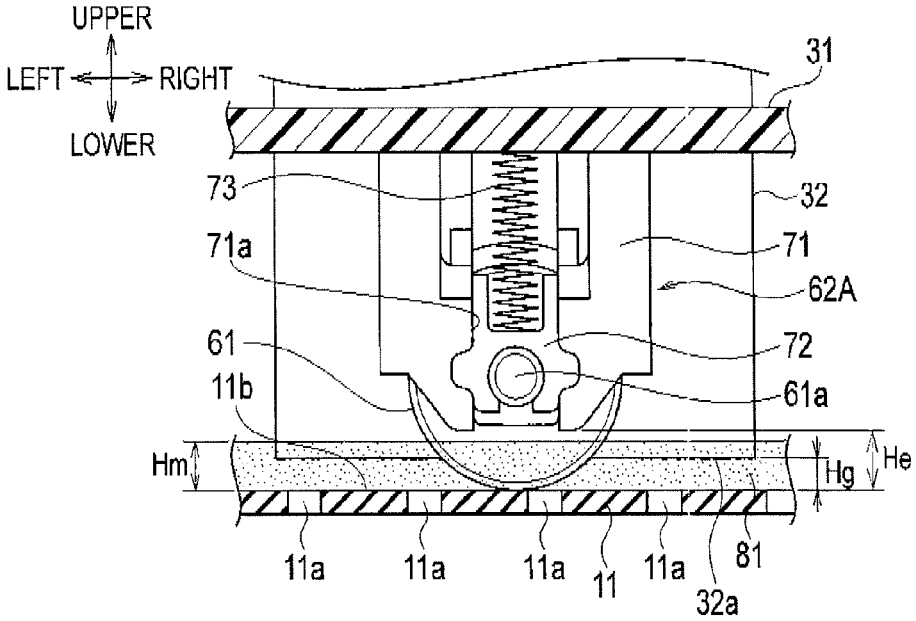
FIG. 3 is a view illustrating a support portion of an inter-head sheet pressing portion in a state in which a lower end of a fixed portion protrudes more downward than a lower end of a movable portion according to the embodiment of the present invention.

As illustrated in FIG. 3, the support portion 62A is provided with a fixed portion 71, a movable portion 72, and a spring 73. The support portion 62B also has a configuration similar to that of the support portion 62A.

The fixed portion 71 guides vertical movement of the movable portion 72. The fixed portion 71 is fixed to the lower surface of the head holder 31. The fixed portion 71 has a guide groove 71*a* for guiding the movable portion 72. The guide groove 71*a* is formed in parallel in a vertical direction.

The movable portion 72 supports the inter-head guide roller 61 rotatably and capable of vertical movement. The rotating shaft 61*a* of the inter-head guide roller 61 is rotatably connected to the movable portion 72. The movable portion 72 is made capable of vertical movement along the guide groove 71*a* of the fixed portion 71. As a result, the movable portion 72 vertically moves in accordance with a change of the head gap Hg, and the inter-head guide roller 61 is vertically moved with that.

The spring 73 gives an elastic force to the movable portion 72. The inter-head guide roller 61 is pressed onto the transfer belt 11 by means of the elastic force of the spring 73. An upper end of the spring 73 is fixed to the lower surface of the head holder 31. A lower end of the spring 73 is fixed to the movable portion 72.

Here, as described above, in the transfer belt 11, the belt holes 11*a* are arranged so that the plurality of belt holes 11*a* continuously passes just below the support portions 62A and 62B when the transfer belt 11 is moving. That is, the support portions 62A and 62B are arranged immediately above the positions where the belt holes 11*a* pass.

Moreover, lower ends of the support portions 62A and 62B are located above the discharge surface 32*a* of the ink head 32. That is, a support portion lower-end height He is larger than the head gap Hg.

Figure 4:
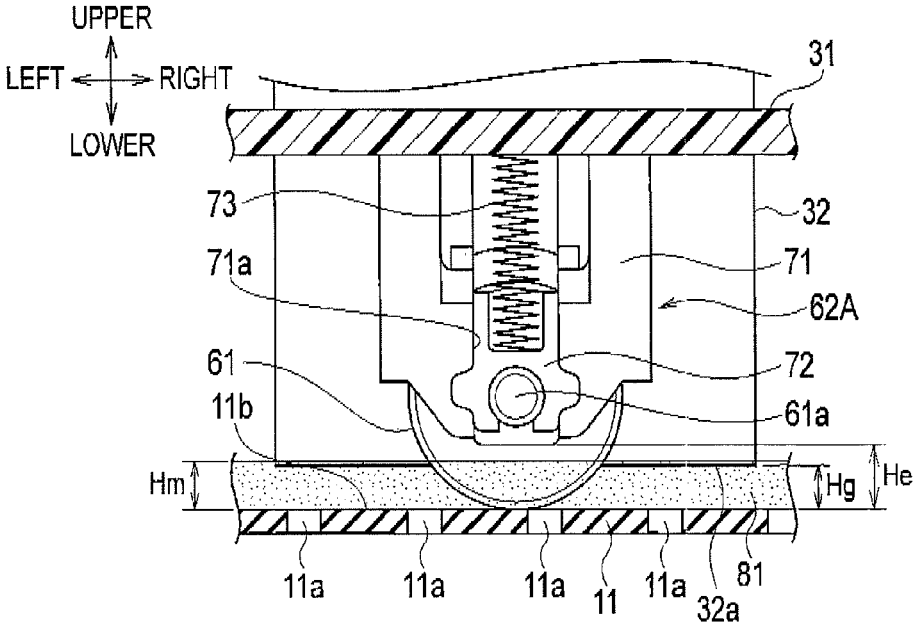
FIG. 4 is a view illustrating the support portion of the inter-head sheet pressing portion in a state in which the lower end of the movable portion protrudes more downward than the lower end of the fixed portion according to the embodiment of the present invention.

The support portion lower-end height He is a height from the transfer surface 11*b* to the lower end of the fixed portion 71. However, when the head gap Hg is relatively large, the lower end of the movable portion 72 protrudes downward from the lower end of the fixed portion 71 in some cases. In this case, as illustrated in FIG. 4, a height from the transfer surface 11*b* to the lower end of the movable portion 72 becomes the support portion lower-end height He. The support portion lower-end height He is set larger than the head gap Hg all the time within a fluctuation range of a size of the head gap Hg set in the printer 1.

Moreover, the support portion lower-end height He is preferably larger than an ink mist floating-area height Hm. The ink mist floating-region height Hm is a height from the transfer surface 11*b* of a region in which an ink mist 81 floats during a printing operation in the printer 1.

Figure 5:
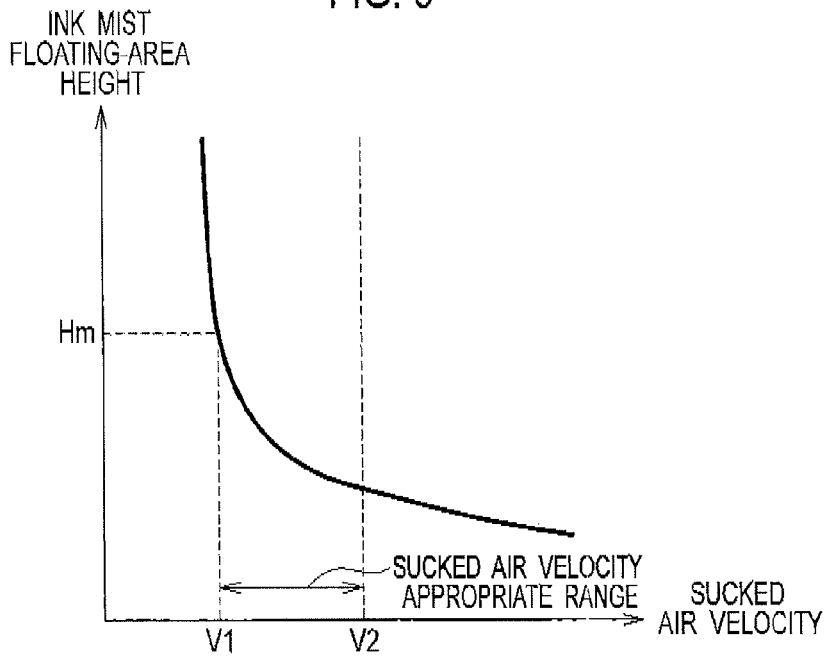
FIG. 5 is a graph illustrating a relationship between a sucked air velocity and an ink mist floating region height according to the embodiment of the present invention.

As illustrated in FIG. 5, the smaller a sucked air velocity by the sucking fan 16 is, the higher the ink mist floats up. The ink mist floating-area height Hm is an ink mist floating-area height at an appropriate lower-limit air velocity V1 which is a lower limit of an appropriate range V1 to V2 of the sucked air velocity in the printer 1.

Here, if the sucked air velocity by the sucking fan 16 is too high, the ink mist increases and hits the sheet P, whereby the sheet P might be stained. On the other hand, if the sucked air velocity is too low, an attraction force of the sheet P to the transfer surface 11*b* is insufficient, and defective transfer might be caused. Thus, in the printer 1, as illustrated in FIG. 5, an appropriate range of the sucked air velocity is set.

Subsequently, an operation of the printer 1 will be described.

When a printing operation is started in the printer 1, driving of the driving roller 12 of the transfer portion 2 and the sucking fan 16 is started.

The driving roller 12 rotates and moves the transfer belt 11 in a clockwise direction in FIG. 1. Moreover, the sucking fan 16 sucks air through the belt holes 11*a* of the transfer belt 11. As a result, a negative pressure is generated in the belt holes 11, and an attraction force is generated.

When the sheet P is fed from a paper feed portion, not shown, the transfer portion 2 attracts and transfers the sheet P onto the transfer surface 11*b* by the attraction force generated in the belt holes 11*a*. Here, the sheet P is pressed onto the transfer surface 11*b* by the upstream-side guide roller 51 and the inter-head guide roller 61 and transferred.

Then, the ink head 32 discharges the ink droplets onto the transferred sheet P to print an image.

When the ink droplets are discharged from the ink head 32, a part of them becomes a mist-state ink mist. The ink mist floats above the transfer surface 11*b*.

Here, during the printing operation, the belt holes 11*a* pass just below the support portions 62A and 62B. When the sheet P attracted onto the transfer surface 11*b* passes below the support portions 62A and 62B, the belt holes 11*a* are closed by the sheet P. On the other hand, between the continuously transferred sheets P, the open belt holes 11*a* pass just below the support portions 62A and 62B. At this time, the ink mist floating above the transfer surface 11*b* is sucked downward through the belt holes 11*a*. Therefore, just below the support portions 62A and 62B, the ink mist is sucked through the belt holes 11*a* between sheets coming at a predetermined interval.

Figure 6:
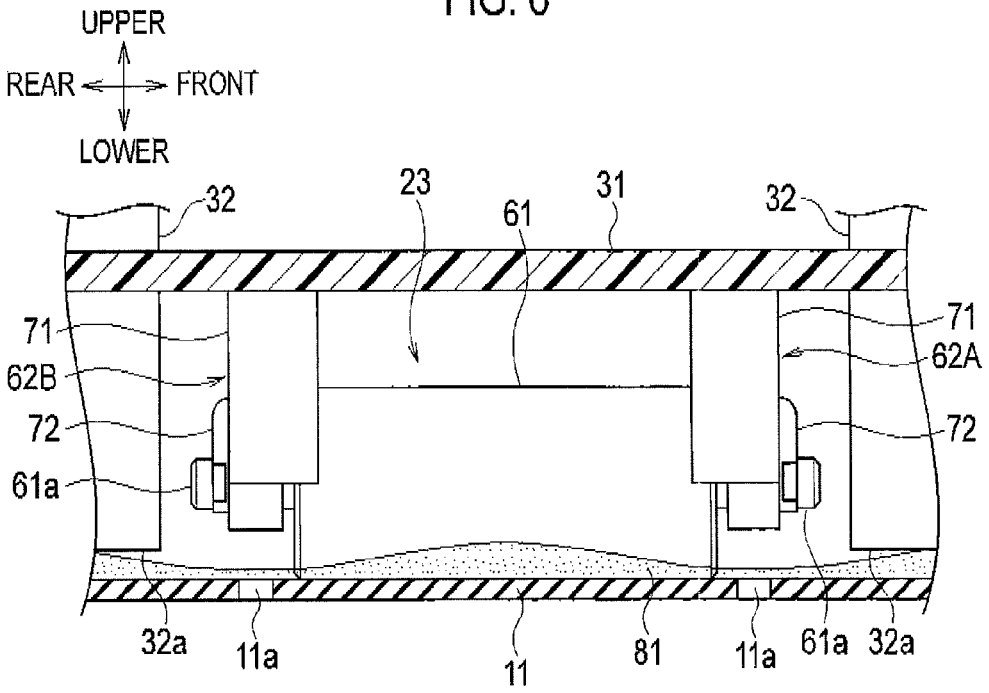
FIG. 6 is an explanatory diagram of the ink mist just below the support portion of the inter-head sheet pressing portion according to the embodiment of the present invention.

As a result, as illustrated in FIG. 6, just below the support portions 62A and 62B, the height of the region in which the ink mist 81 floats is kept low. Thus, adhesion of the ink mist 81 to the support portions 62A and 62B is suppressed.

Moreover, as described above, the support portion lower-end height He is larger than the head gap Hg. The ink mist might float above the discharge surface 32*a* but tends to float more between the discharge surface 32*a* and the transfer surface 11*b*. Moreover, the height of the region in which the ink mist floats is kept low just below the support portions 62A and 62B by means of above described sucking of the ink mist. Thus, since the support portion lower-end height He is larger than the head gap Hg, that is, since the lower ends of the support portions 62A and 62B are located above the discharge surface 32*a*, adhesion of the ink mist to the support portions 62A and 62B is further suppressed. Moreover, by setting the support portion lower-end height He larger than the ink mist floating-region height Hm, adhesion of the ink mist 81 to the support portions 62A and 62B can be further suppressed.

Figure 7:
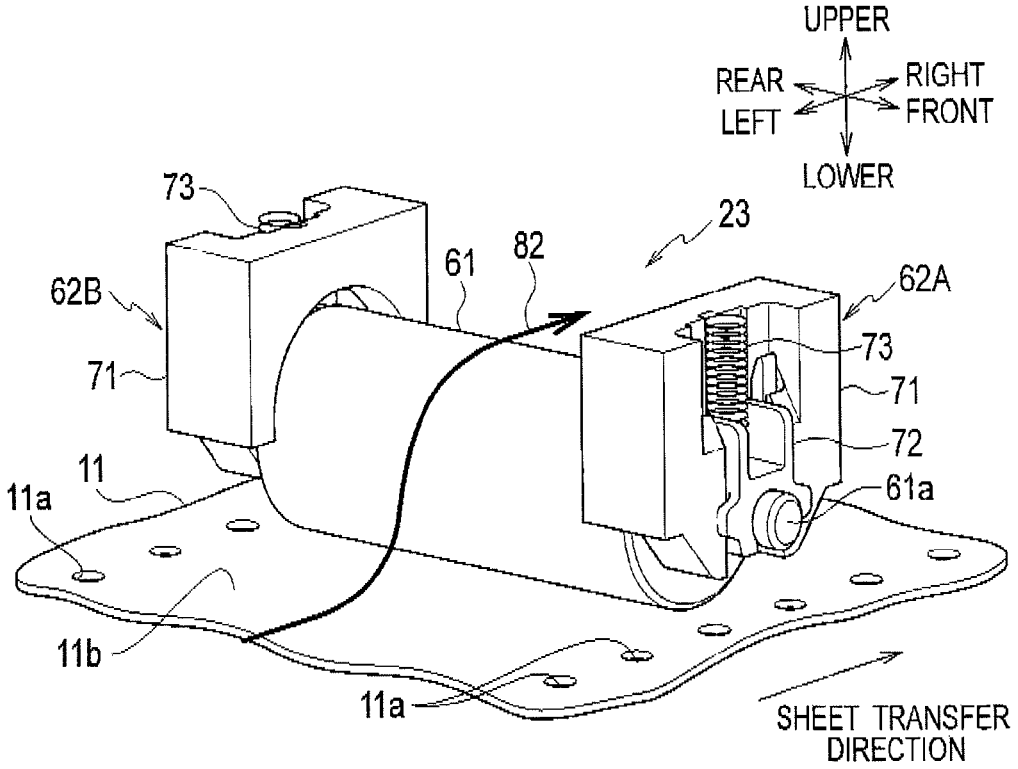
FIG. 7 is an explanatory diagram of a flow of the ink mist in the vicinity of an inter-head guide roller according to the embodiment of the present invention.

Moreover, during the above described printing operation, the inter-head guide roller 61 follows and rotates with the transfer belt 11. An air flow caused by rotation is generated in the vicinity of the surface of the inter-head guide roller 61. The ink mist flows upward along the inter-head guide roller 61 by means of this air flow, as illustrated by a bold arrow 82 in FIG. 7. Due to this phenomenon, the ink mist does not easily adhere to the inter-head guide roller 61. Moreover, the surface of the inter-head guide roller 61 is applied with the ink repellant treatment, which also makes adhesion of the ink mist difficult.

Because of the reason similar to the difficulty in adhesion of the ink mist to the inter-head guide roller 61, the ink mist does not easily adhere to the upstream-side guide roller 51 of the upstream-side sheet pressing portion 22, either. Moreover, since the support portions 52A and 52B of the upstream-side sheet pressing portion 22 are arranged outside the region in which the ink heads 32 are arranged, the ink mist does not adhere easily.

As described above, though the ink mist is generated during the printing operation in the printer 1, the ink mist does not adhere easily to each of the upstream-side sheet pressing portion 22 and the inter-head sheet pressing portion 23. As a result, the sheet P is being transferred and printed while adhesion of stains is suppressed.

Regarding those not sandwiched by the ink heads 32 in the longitudinal direction among the twenty-four inter-head sheet pressing portions 23, the support portion 62A or 62B may be arranged outside the region in which the ink heads 32 are arranged. For example, the support portion 62A of the inter-head sheet pressing portion 23 on the frontmost side on the line formed by the head row 41A may be arranged at a position similar to that of the support portion 52A of the upstream-side sheet pressing portion 22 in the longitudinal direction. In this case, it is only necessary that the inter-head guide roller 61 is made longer than the other inter-head sheet pressing portions 23.

As described above, the printer 1 has the inter-head guide roller 61 arranged in parallel to the ink heads 32 on the line formed by each of the head rows 41. As a result, when the sheet P passes below the discharge surface 32*a* of the ink head 32, the sheet P can be pressed onto the transfer surface 11*b* by the inter-head guide roller 61. As a result, even if the sheet P is curled, for example, contact of the sheet P with the ink head 32 can be reduced.

Moreover, in the printer 1, the belt holes 11*a* are arranged so that the plurality of belt holes 11*a* passes just below the support portions 62A and 62B when the transfer belt 11 is moving. As a result, the height of the region in which the ink mist floats just below the support portions 62A and 62B can be kept low. Thus, adhesion of the ink mist to the support portions 62A and 62B can be suppressed. Therefore, even if the sheet P is brought into contact with the support portions 62A and 62B, stains on the sheet P can be suppressed. Moreover, the ink mist accumulated on the support portions 62A and 62B is prevented from becoming ink droplets and dropping onto the sheet P to stain it.

Moreover, since the inter-head guide roller 61 is rotating during the printing operation, the ink mist does not easily adhere to the inter-head guide roller 61. Thus, stains on the sheet P caused by adhesion of the ink mist to the inter-head guide roller 61 is suppressed.

Therefore, according to the printer 1, contact of the sheet P with the ink head 32 can be reduced while stains on the sheet P are suppressed.

Moreover, according to the printer 1, since the lower ends of the support portions 62A and 62B are located above the discharge surface 32*a*, adhesion of the ink mist onto the support portions 62A and 62B can be further suppressed. As a result, stains on the sheet P can be further suppressed.

The present invention is not limited to the above described embodiment but can be embodied by varying the constituent elements within a range not departing from the gist thereof in the practical stage. Moreover, various inventions can be formed by appropriately combining a plurality of the constituent elements disclosed in the above described embodiment. For example, some constituent elements may be deleted from all the constituent elements illustrated in the embodiment.

What is claimed is:

1. A printer comprising:

a transfer belt that has a plurality of belt holes, attracts and holds a sheet on a transfer surface, and moves to transfer the sheet;

a suction device that sucks air through the plurality of belt holes to attract the sheet onto the transfer surface of the transfer belt;

a printer that has a head row in which a plurality of ink heads, each discharging an ink droplet from a discharge surface thereof facing the transfer surface is aligned along a main scanning direction orthogonal to a transfer direction of the sheet, and a head holder that holds the plurality of the ink heads; and a sheet pressing roller that is arranged in parallel to the plurality of ink heads on a line formed by the head row, the sheet pressing roller presses the sheet onto the transfer surface while rotating, wherein the sheet pressing roller is a supported by a pair of support portions fixedly arranged on the head holder on one end side and the other end side of the sheet pressing roller; and the plurality of belt holes is arranged on the transfer belt so that each of the plurality of belt holes are positioned directly below one of the support portions, while the transfer belt is moving.

2. The printer according to claim 1, wherein a lower end of each support portion is located above the discharge surface of the ink head.

3. The printer according to claim 1, a distance between the transfer surface and a lowermost portion of the support portion is larger than a height of an ink mist floating region.

4. The printer according to claim 1, wherein the belt holes are arranged in pairs of rows extending along the sheet transport direction, and rows of a row pair are spaced by a distance corresponding to a length of the sheet pressing roller.

5. A printer comprising:

a transfer belt that has a plurality of belt holes, attracts and holds a sheet on a transfer surface, and moves to transfer the sheet;

a suction device that sucks air through the plurality of belt holes to attract the sheet onto the transfer surface of the transfer belt;

a printer that has a head row in which a plurality of ink heads, each discharging an ink droplet from a discharge surface thereof facing the transfer surface is aligned along a main scanning direction orthogonal to a transfer direction of the sheet, and a head holder that holds the plurality of the ink heads; and a sheet pressing roller that is arranged in parallel to the plurality of ink heads on a line formed by the head row, the sheet pressing roller presses the sheet onto the transfer surface while rotating, wherein the sheet pressing roller is rotatably supported by a pair of support portions fixedly arranged on the head holder on one end side and the other end side of the sheet pressing roller; and the plurality of belt holes is arranged on the transfer belt only in a pair of rows extending along the sheet transport direction and passing directly below the pair of support portions.

6. The printer according to claim 5, wherein a lower end of each support portion is located above the discharge surface of the ink head.

7. The printer according to claim 5, wherein a distance between the transfer surface and a lowermost portion of the support portion is larger than a height of an ink mist floating region.

* * * * *